US007749105B2

(12) United States Patent
Zielke et al.

(10) Patent No.: US 7,749,105 B2
(45) Date of Patent: Jul. 6, 2010

(54) GOLF CLUB HEAD WITH INSERT HAVING INDICIA THEREIN

(76) Inventors: Donovan Zielke, 2408 Brookridge Dr., Plainfield, IL (US) 60544; Roger Twibell, 6530 Wenonga Rd., Mission Hills, KS (US) 66208; John Mathews, 12530 S. Crest Dr., Olathe, KS (US) 66061

( * ) Notice: Subject to any disclaimer, the term of this patent is extended or adjusted under 35 U.S.C. 154(b) by 705 days.

(21) Appl. No.: 11/281,058

(22) Filed: Nov. 16, 2005

(65) Prior Publication Data

US 2007/0111816 A1 May 17, 2007

(51) Int. Cl.
*A63B 53/06* (2006.01)

(52) U.S. Cl. ..... 473/350

(58) Field of Classification Search ..... 473/334, 473/335, 336, 337, 338, 339, 350
See application file for complete search history.

(56) References Cited

U.S. PATENT DOCUMENTS

| | | | | |
|---|---|---|---|---|
| 2,056,335 | A | 10/1936 | Wettlaufer | |
| 2,686,056 | A | 8/1954 | Oquist | |
| 2,880,002 | A | 3/1959 | Wetty | |
| 3,708,172 | A * | 1/1973 | Rango | 473/249 |
| 3,749,408 | A | 7/1973 | Mills | |
| 3,814,437 | A | 6/1974 | Winquist | |
| 3,815,910 | A | 6/1974 | Raines | |
| 3,841,640 | A | 10/1974 | Gaulocher | |
| 3,873,094 | A * | 3/1975 | Sebo et al. | 473/250 |
| 3,884,477 | A | 5/1975 | Bianco | |
| 4,369,974 | A | 1/1983 | Komperda | |
| 4,573,685 | A | 3/1986 | Young, IV et al. | |
| 4,749,196 | A | 6/1988 | Podgor | |
| D334,039 | S | 3/1993 | Tanaka | |
| D349,319 | S | 8/1994 | Bayer | |
| 5,460,377 | A | 10/1995 | Schmidt et al. | |
| 5,467,989 | A | 11/1995 | Good et al. | |
| 5,605,510 | A | 2/1997 | Schmidt et al. | |
| 5,690,879 | A | 11/1997 | Lee | |
| 5,749,791 | A | 5/1998 | Passeri, Jr. | |
| 5,842,935 | A | 12/1998 | Nelson | |
| 5,924,939 | A | 7/1999 | Grace et al. | |
| 5,972,144 | A | 10/1999 | Hsu | |
| 6,059,669 | A | 5/2000 | Pearce | |
| D437,017 | S | 1/2001 | Ford | |
| 6,200,229 | B1 | 3/2001 | Grace et al. | |

(Continued)

FOREIGN PATENT DOCUMENTS

JP 02268780 A2 11/1990

*Primary Examiner*—Raeann Trimiew
(74) *Attorney, Agent, or Firm*—Brian B. Diekhoff; Polsinelli Shughart PC

(57) ABSTRACT

In accordance with one embodiment of the present invention a golf club head is provided. The club head includes a heel, toe, front portion with a defined striking face, a back portion, an upper surface and a lower surface. An aperture is defined in the body as extending from the upper surface to the lower surface and extending from the front portion to an inside portion. An insert is further provided and is secured within the aperture. Lastly, an indicia is provided within the insert and is visible through the upper surface and lower surface of the golf club head. Furthermore, the aperture may extend from the striking face such that the insert of mating configuration to the aperture forms at least a portion of the striking face.

14 Claims, 11 Drawing Sheets

U.S. PATENT DOCUMENTS

| | | | | |
|---|---|---|---|---|
| 6,244,972 | B1 | 6/2001 | Drossos | |
| 6,364,788 | B1 * | 4/2002 | Helmstetter et al. | 473/324 |
| 6,478,694 | B2 | 11/2002 | Anderson et al. | |
| 6,524,196 | B1 | 2/2003 | Yeh | |
| D485,321 | S | 1/2004 | Breier et al. | |
| 6,729,972 | B2 | 5/2004 | Boord | |
| 6,743,114 | B2 | 6/2004 | Best | |
| 6,835,144 | B2 | 12/2004 | Best | |
| 6,951,518 | B2 | 10/2005 | Solheim et al. | |
| 6,986,716 | B2 | 1/2006 | Lukasiewicz, Jr. et al. | |
| D523,102 | S | 6/2006 | Stites et al. | |
| 7,086,957 | B2 | 8/2006 | Solheim et al. | |
| 7,108,613 | B1 * | 9/2006 | Gordon et al. | 473/341 |
| 7,112,147 | B2 | 9/2006 | Solheim et al. | |
| 7,115,041 | B2 | 10/2006 | Guard et al. | |
| 7,294,066 | B1 | 11/2007 | Richard, Jr. | |
| 7,309,291 | B1 | 12/2007 | Bryant et al. | |
| D564,607 | S | 3/2008 | Oldknow et al. | |
| 7,344,451 | B2 | 3/2008 | Tang et al. | |
| 7,351,162 | B2 | 4/2008 | Soracco et al. | |
| 2001/0055212 | A1 | 12/2001 | Phillips | |
| 2003/0017885 | A1 | 1/2003 | Heene et al. | |
| 2003/0032497 | A1 | 2/2003 | Sano | |
| 2003/0054899 | A1 | 3/2003 | Dupille | |
| 2003/0148821 | A1 | 8/2003 | Morgan et al. | |
| 2003/0203766 | A1 | 10/2003 | Sano et al. | |
| 2005/0043111 | A1 | 2/2005 | Albert et al. | |
| 2005/0233109 | A1 | 10/2005 | Hettinga | |
| 2007/0111816 | A1 | 5/2007 | Zielke et al. | |

* cited by examiner

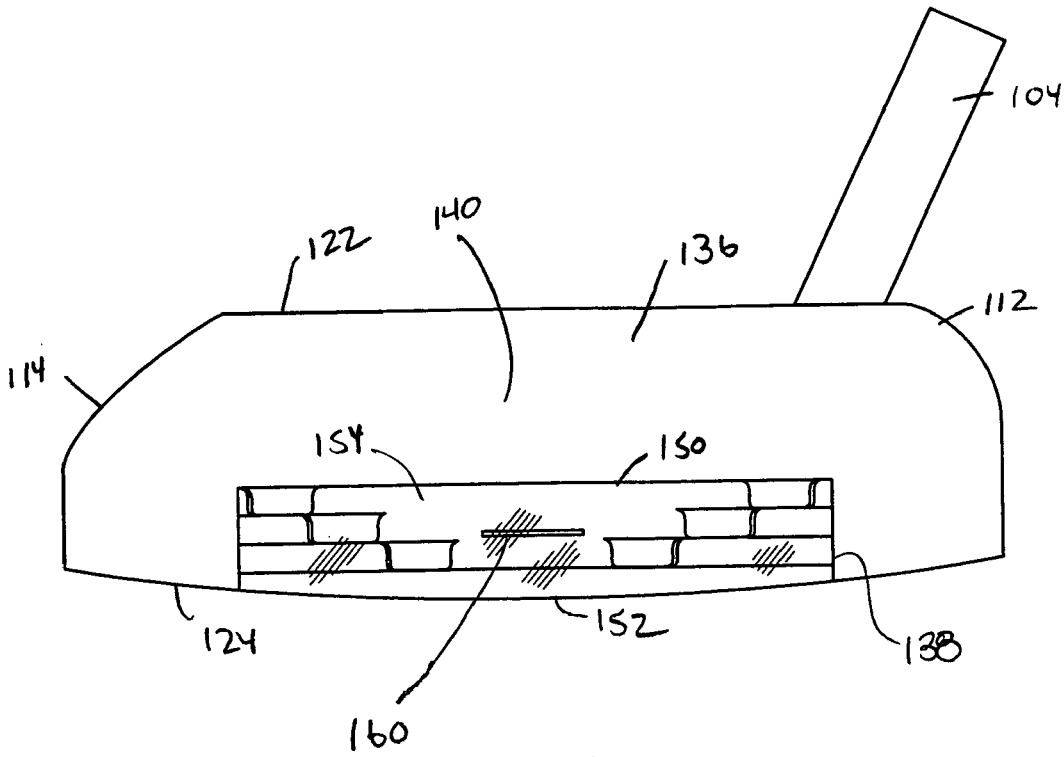
Fig 2
Fig 3
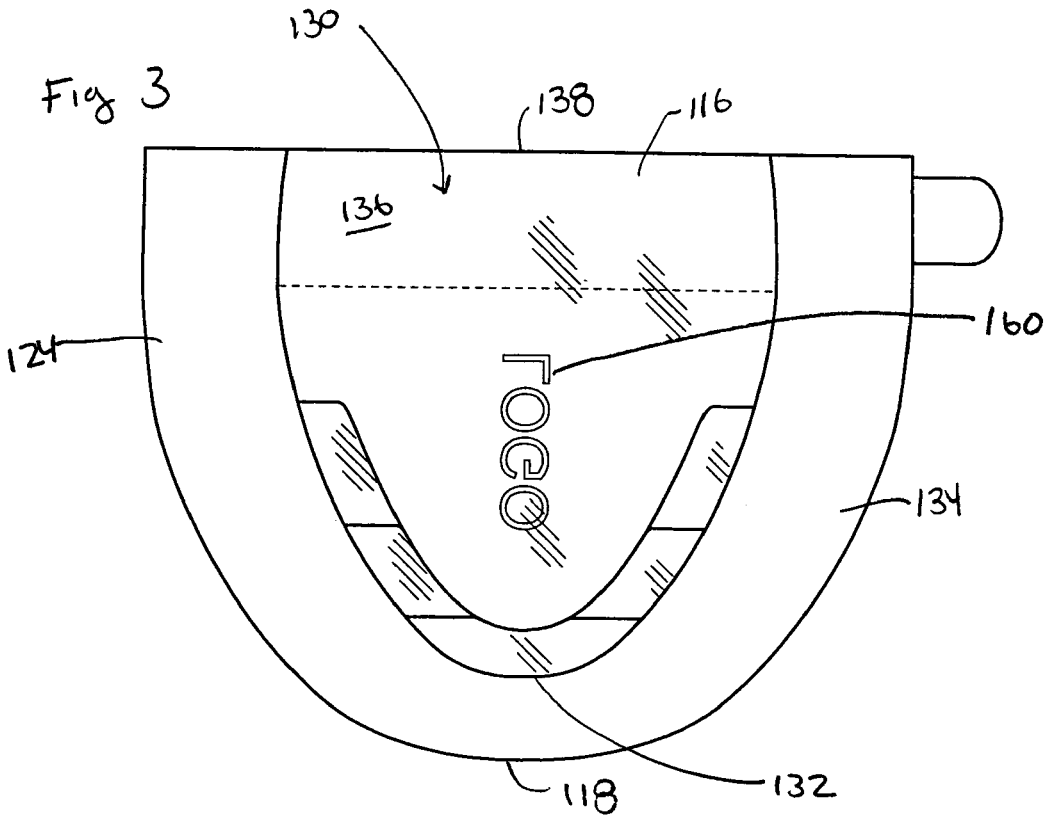

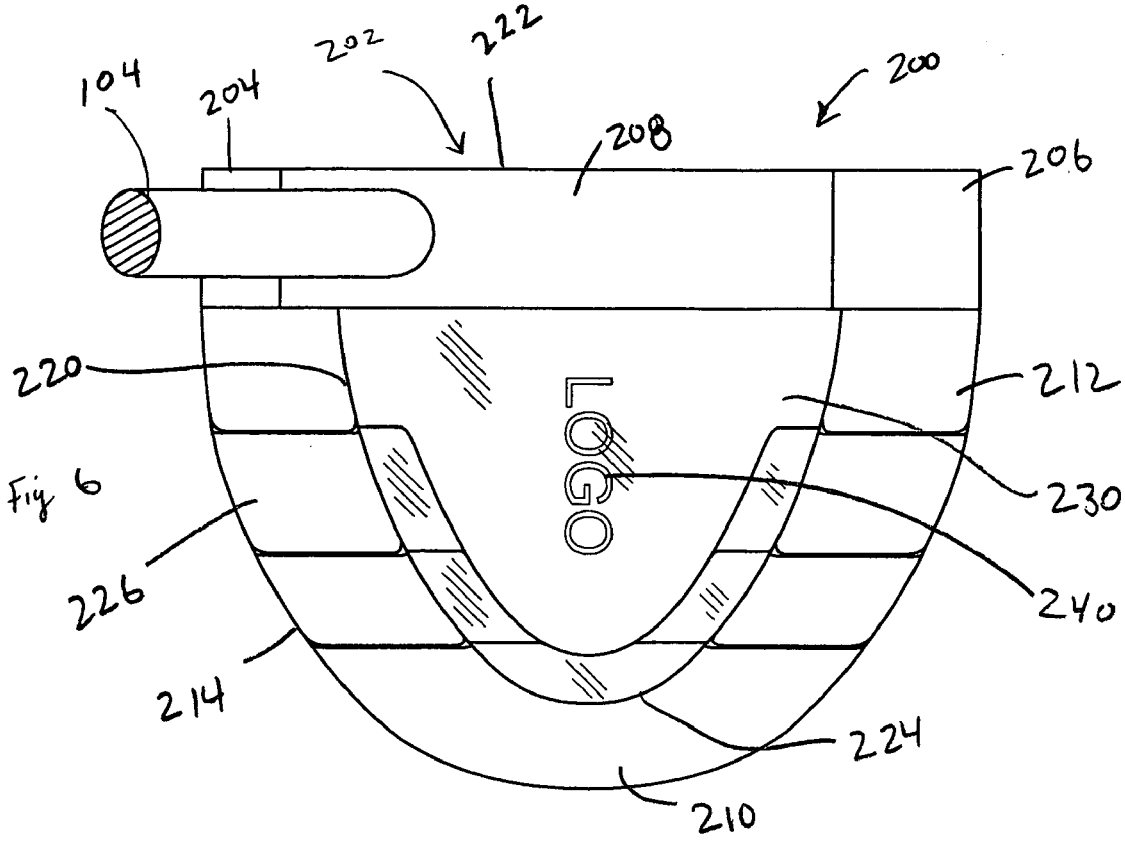
Fig 6
Fig 7
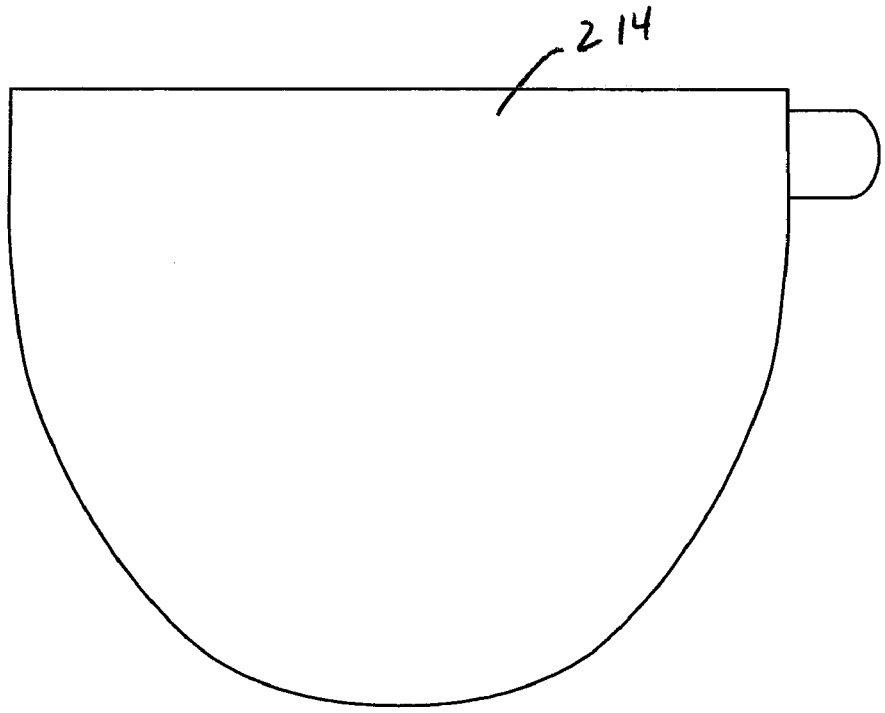

104
222
222
230
212
208
206
204
232
214
240

GOLF CLUB HEAD WITH INSERT HAVING INDICIA THEREIN

FIELD OF THE INVENTION

The present invention relates to a golf club head, more specifically, the present invention relates to a golf club head with a transparent insert that has indicia therein.

BACKGROUND OF THE INVENTION

Various kinds of putter heads with inserts are known in the prior art. For example, U.S. Patent Publication 2005/0043111 to Albert et al relates to the placement of a polymer insert in a recess. The recess can be formed in the striking plate of a putter head or the crown of a wood head. Within the recess is a pattern or logo.

In another example, U.S. Patent Publication 2003/0017885 discloses the use of a polymer insert, which has indicia printed on the surface of the insert, that is disposed in a recess of the club face. The indicia is only visible through the club face.

In another example, U.S. Pat. No. 6,729,972 is directed to having an putter head with a three layer insert placed in a recess in the club face. The three layer insert includes a middle indicia layer. The indicia is thus only visible from the front of the club face.

Other examples include U.S. Pat. Nos. 5,605,510 and 5,460,377 which are directed to having an putter head with a recess and a monogrammed insert. The indicia is visible rearwardly or through the front face depending upon the direction of the monogram. U.S. Pat. Nos. 6,200,229 and 5,924,939 disclose having two layers of differently colored material. The first layer is molded with projections, and the other with corresponding recesses which the projections fit into. The projections have visible through the front strike face of the insert.

In addition, U.S. Pat. No. 5,972,144 is directed to manufacturing a golf club head that includes adhering a decorative plate on a recess in the striking face and pouring a resin over the face to secure the place therein. The indicia is thus only visible from the front of the club face.

Although various golf club heads with inserts and indicia have been disclosed, the prior art does not provide for the advantages and objectives of the present invention.

SUMMARY OF THE INVENTION

In accordance with one embodiment of the present invention a golf club head is provided. The club head includes a heel, toe, front portion with a defined striking face, a back portion, an upper surface and a lower surface. An aperture is defined in the body as extending from the upper surface to the lower surface and extending from the front portion to an inside portion. The inside portion may be defined as a portion between the front portion and the back portion. An insert is further provided and is secured within the aperture. Lastly, an indicia is provided within the insert and is visible through the upper surface and lower surface of the golf club head. Furthermore, the aperture may extend from the striking face such that the insert of mating configuration to the aperture forms at least a portion of the striking face. Preferably, the insert is of a transparent or semi transparent material.

In another embodiment of the present invention, a golf club is provided with a heel, toe, front portion with a defined striking face, a back portion, an upper surface and a lower surface. A recess is provided in the body and is defined as extending downwardly from the upper surface and extending inwardly from the striking face. An insert is secured within the recess such that the insert forms a portion of the striking face. An indicia within the insert is provided that is visible through the upper surface.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 2 is a front view of the club head from FIG. 1;

FIG. 3 is a bottom view of the club head FIG. 1;

FIG. 6 is a top view of a second club head in accordance with the present invention;

FIG. 7 is a bottom view of FIG. 6;

DETAILED DESCRIPTION OF THE EMBODIMENTS

Figure 1:
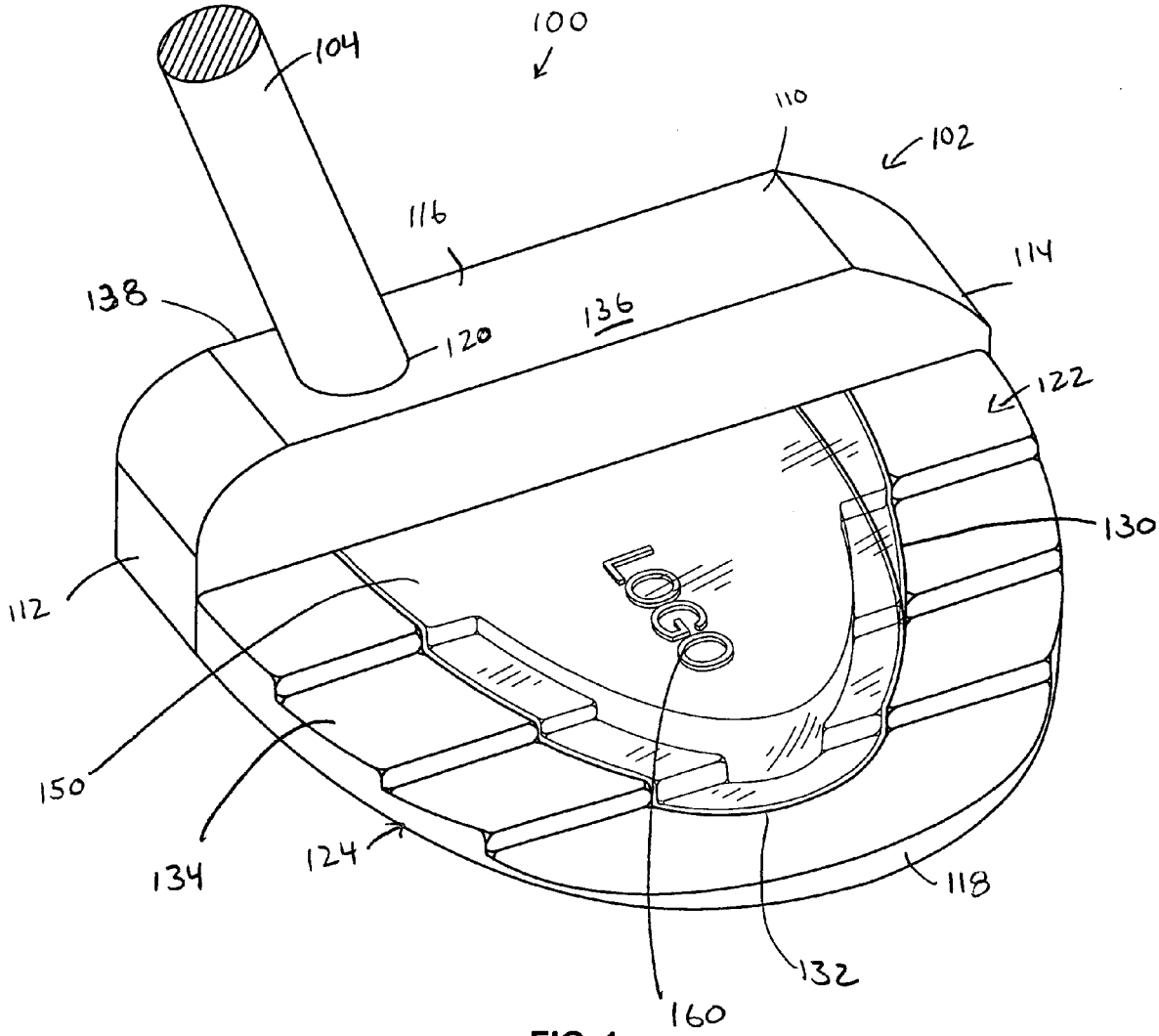
FIG. 1 is a rear perspective view of the club head in accordance with the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIGS. 1-5, there is shown a first illustrative embodiment golf club head in accordance with the present invention, designated generally at 100, as part of a golf club 102, with only part of the shaft 104 being visible.

The golf club head 100 is shown as a putter, however, the golf club may take any form of club. The club head 100 comprises a body 110 having a heel 112, toe 114, a front portion 116 and a back portion 118. The shaft 104 is secured to a hosel 120 in the front portion of the club head 100 or may be secured directly into the club head 100. The body 110 further includes an upper surface 122 and a bottom surface 124. The body 110 also includes an aperture 130 formed from the front portion 116 to an inside portion 132. In the first embodiment, the aperture 130 extends from the front striking face 138 to the inside portion 132. The front striking face 138 is a region defined on the front face 140 of the club that is used to strike a ball (not shown). The inside portion 132 is defined as a point between the front portion 116 and the back portion 118 but may very well extend all the way to the back portion 118. As illustrated, a backside arc portion 134 extends from heel 112 to toe 114 and from front portion 116 to back portion 118 to create the aperture 130 therebetween. In addition, as illustrated, a U-shaped bridge 136 is formed on the front face 140 from heel 112 to toe 114 over the aperture 130.

In the first embodiment, the aperture 130 provides the ability to have a transparent, semi-transparent, see-through or visible window through the club head from the upper surface 122 to the lower surface 124. The aperture 130 is filled with a material to create an insert 150 that further facilities the visible window. The insert 150, in accordance to the first embodiment includes a lower surface 152 that extends the lower surface 124 of the body from heel 112 to toe 114, and includes an upper surface 156. As shown, the lower surfaces 152 and 124 may be curved, however, it is contemplated that the lower surfaces be straight or planar. The insert 150 further includes a striking region 154 at the striking face 138. As such, the insert 150 not only provides a visible window from the upper surface 122 to the lower surface 124 but also provides a striking face 138.

Embedded in the insert 150 is indicia 160. The indicia may be any logo, word, letter, number, design, or combination thereof. In accordance to the first embodiment, the indicia 160 is visible from the upper surface 122 when the club 100 is in use and visible from the lower surface 124 when the club is turned upside down and resting in a golf bag. While the indicia 160 is shown in reverse on the lower surface 124 the present invention contemplates having the indicia 160 on both sides of a non see-through plate, such that the indicia 160 can be read and/or properly viewed when the club 100 is in use or turned upside down. In addition, the indicia may be different on both sides such that different logos or information may be viewed from the top then from the bottom.

Preferably, the body is formed as an integral piece of material. However, it can be constructed in pieces and assembled. In the preferred embodiment, the body is made from one or more of the following material, bismuth metal, bismuth oxide, bismuth trioxide, barium sulfate, calcium carbonate, alumina, mica, iron, iron oxide, zirconium, zirconate, ceramic, carbon, glass spheres, plastic spheres, ceramic spheres, copper, zinc, zinc oxide, stainless steel, tungsten, lead or titanium. The material may further be reinforced with one or more of the following materials: fiber glass, carbon fiber, ceramic fibers, aramid (Kevlar), polyester fiber, nylon, cotton, wool, or acrylic. The reinforced material can be strands, mesh or woven.

Preferably the insert is formed as an integral piece of material. In the preferred embodiment, the insert is made from a thermoset plastic, such as a thermoplastic transparent polymer, urethane, polyurethane, aliphatic, or aromatic. Other materials that may be used include epoxy, polyester, vinyl ester, phenolics, styrenes, or thermoset rubber.

Figure 4:
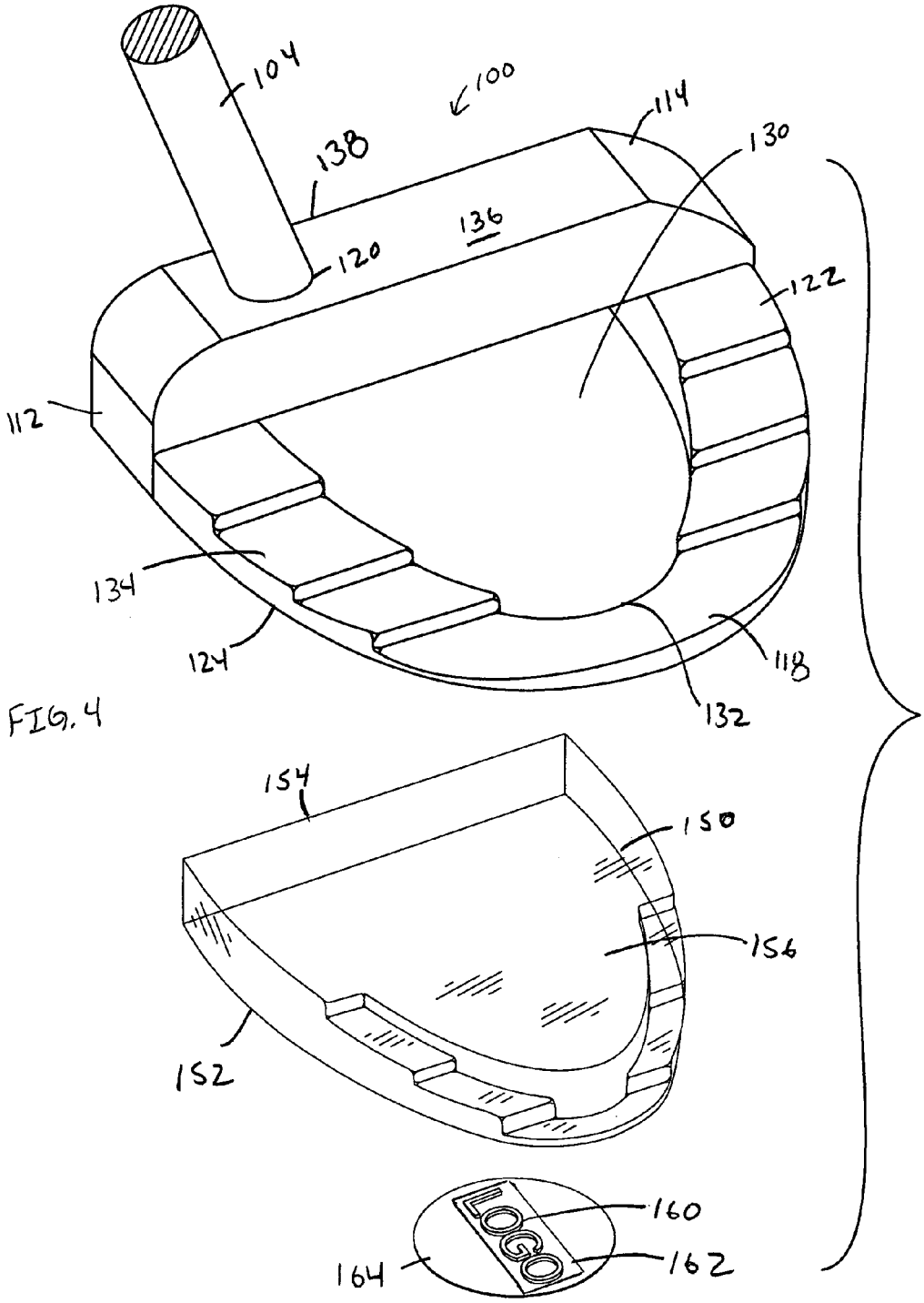
FIG. 4 is an exploded view of the assembled club head from FIG. 1.
Figure 5:
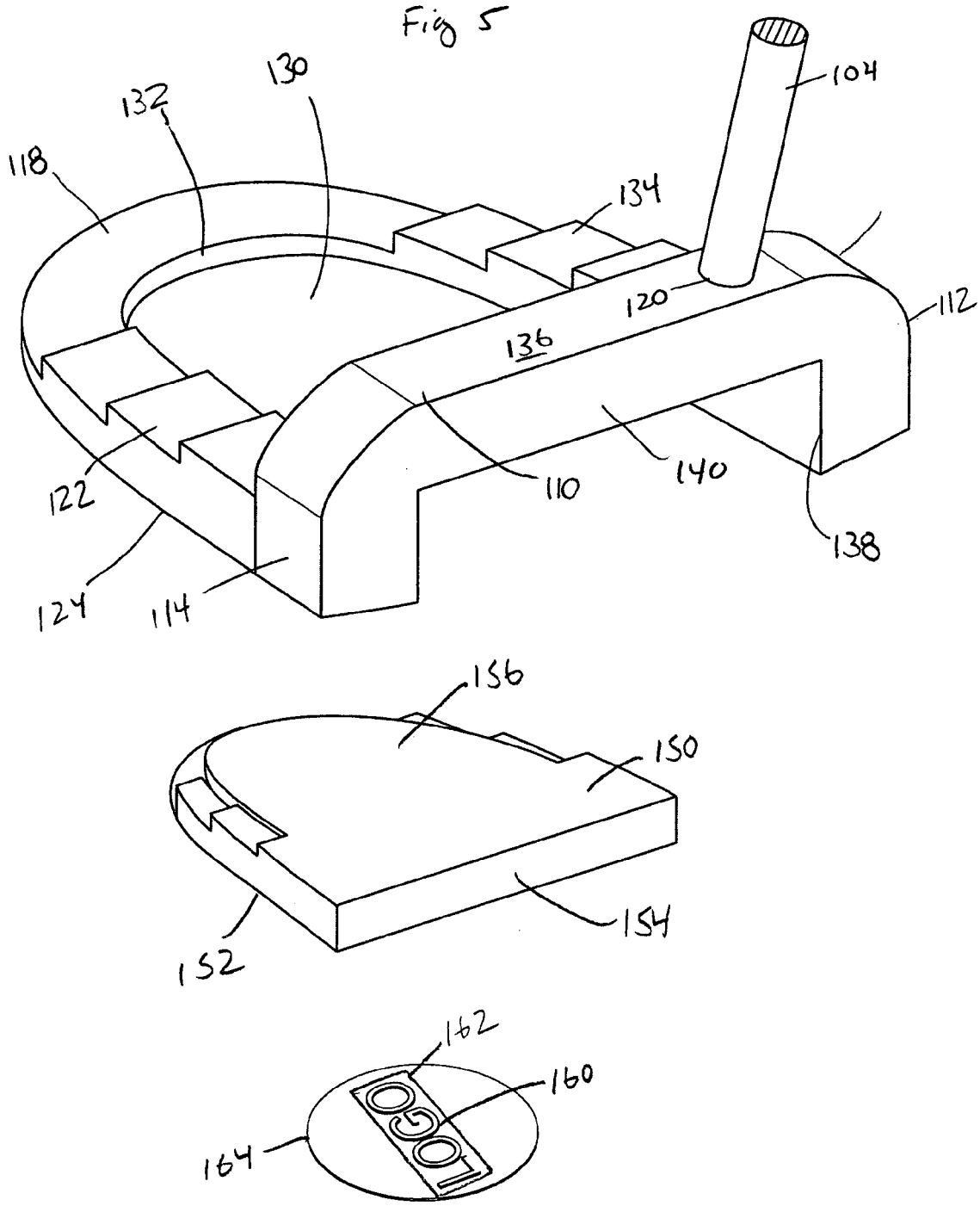
FIG. 5 is a rear perspective exploded view of FIG. 1.

Referring now to FIGS. 4 and 5, in the manufacturing process of the first embodiment of the present invention, the indicia 160 may be placed on a board 162. The board 162 may be transparent, semi transparent or opaque. The indicia 160 (with or without the board 162) is mounted onto a Mylar film or other transparent material 164. The transparent material 164 is held in a mold while the insert material is cast there around it to form said insert 154 with the indicia 160 position therein. After the insert 154 has set or is finished, the insert 154 is held in a mold while the body material is cast there around and allowed to set. When placed on an opaque board, an identical or second indicia would be placed on the underside of the board as well as being placed on the upperside of board. This would provide for indicia that is properly read or seen from both the upper surface and the lower surface of the club head.

Figure 8:
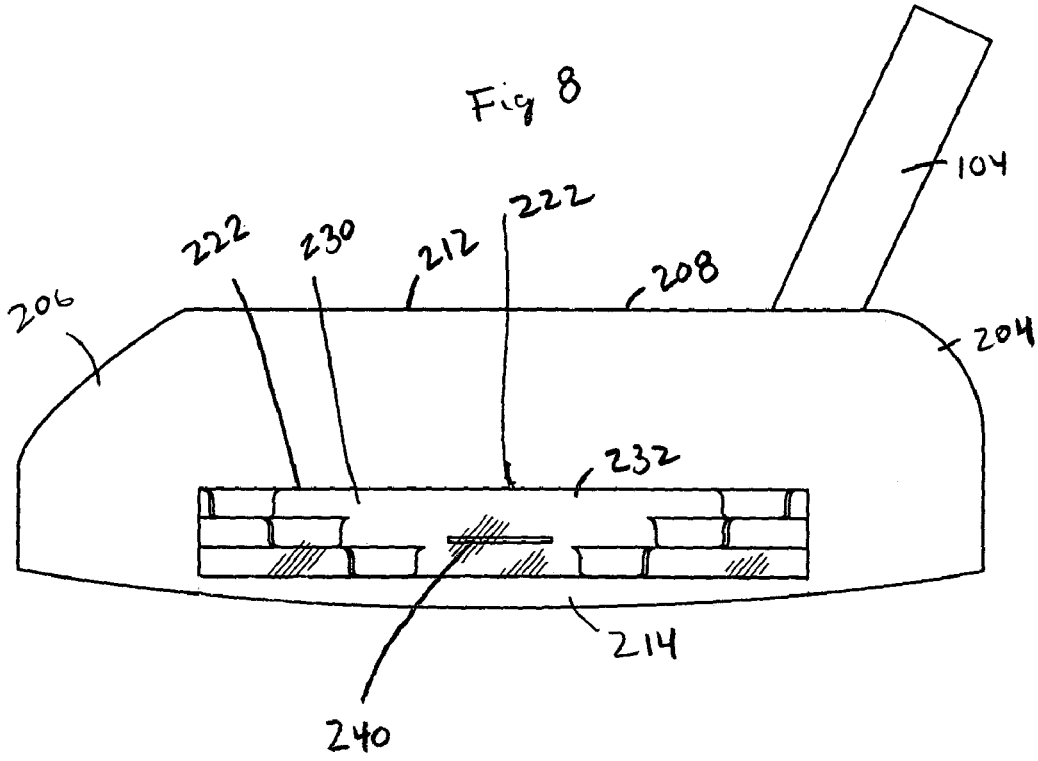
FIG. 8 is a front view of FIG. 6.

In a second embodiment of the present invention, FIGS. 6-8, the golf club head 200 includes a body 202 defined with a heel 204, toe 206, a front portion 208 and a back portion 210. The body 202 of the golf club head further includes an upper surface 212 and a bottom surface 214. The body 210 also includes a recess 220 formed from a front striking face 222 to an inside portion 224. (The inside portion 224 defined as a point between the front striking face 222 and the back portion 210 but may very well extend all the way to the back portion 210.) The recess 220 further extends downwardly from the upper surface 212 towards the bottom surface 214. However, the bottom surface 214 is still maintained as part of the body 202.

The recess 220 has secured therein an insert 230. The insert 230 forms a portion 232 of the front striking face 222. Within the insert 230 is indicia 240 that is visible through the upper surface 212 of the club head 200.

Figure 9:
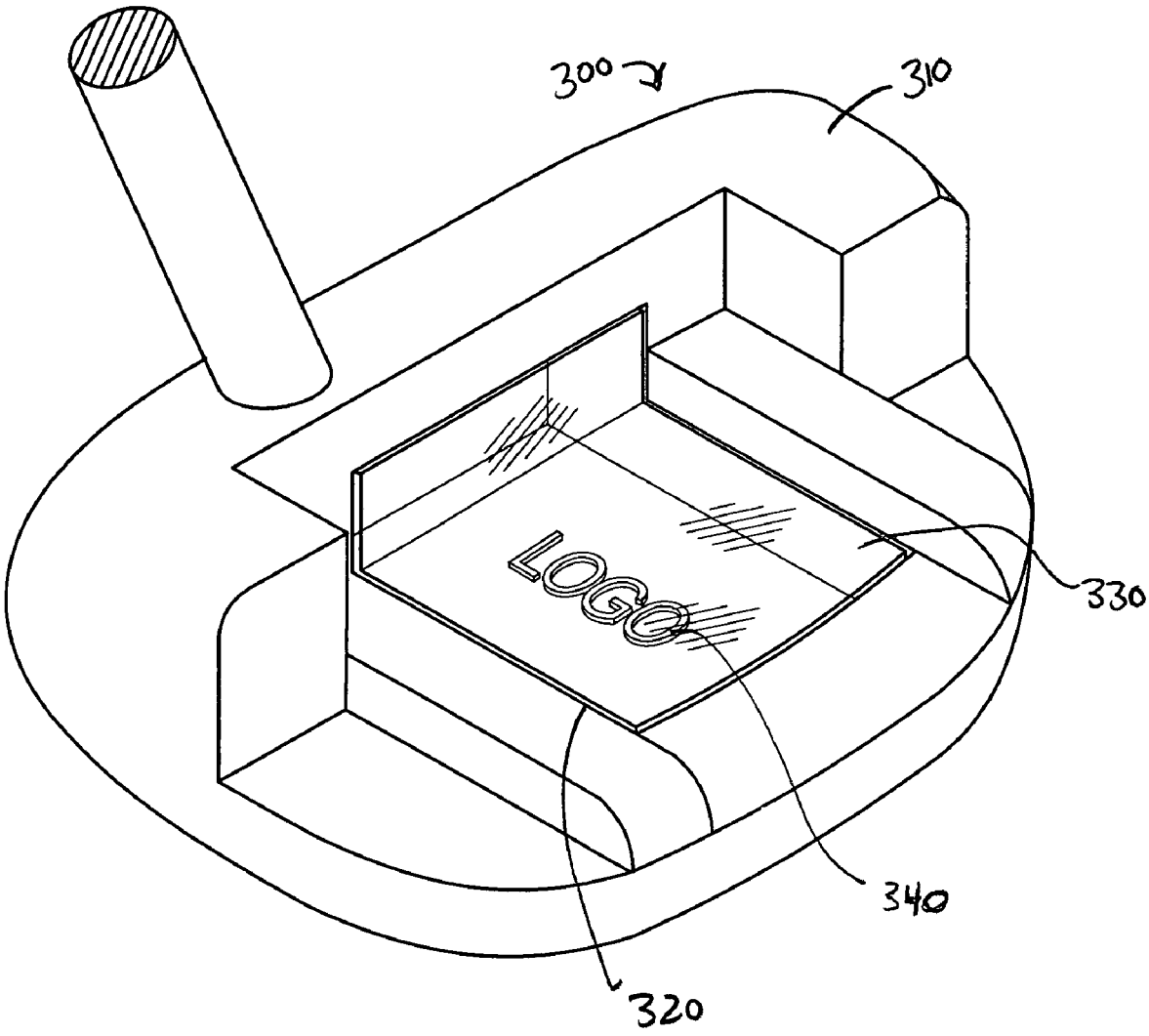
FIG. 9 is a rear perspective view of an alternative club head in accordance with the present invention.

In a third embodiment of the present invention, FIG. 9, the golf club head 300 includes a body 310 shaped differently then the previous embodiments. The third embodiment still includes an aperture or recess 320 with an insert 330 that has indicia 340 that is visible through the upper surface of the body. It is simply included to show that alternative club head designs may be used without deviating from the scope and spirit of the invention.

Figure 10:
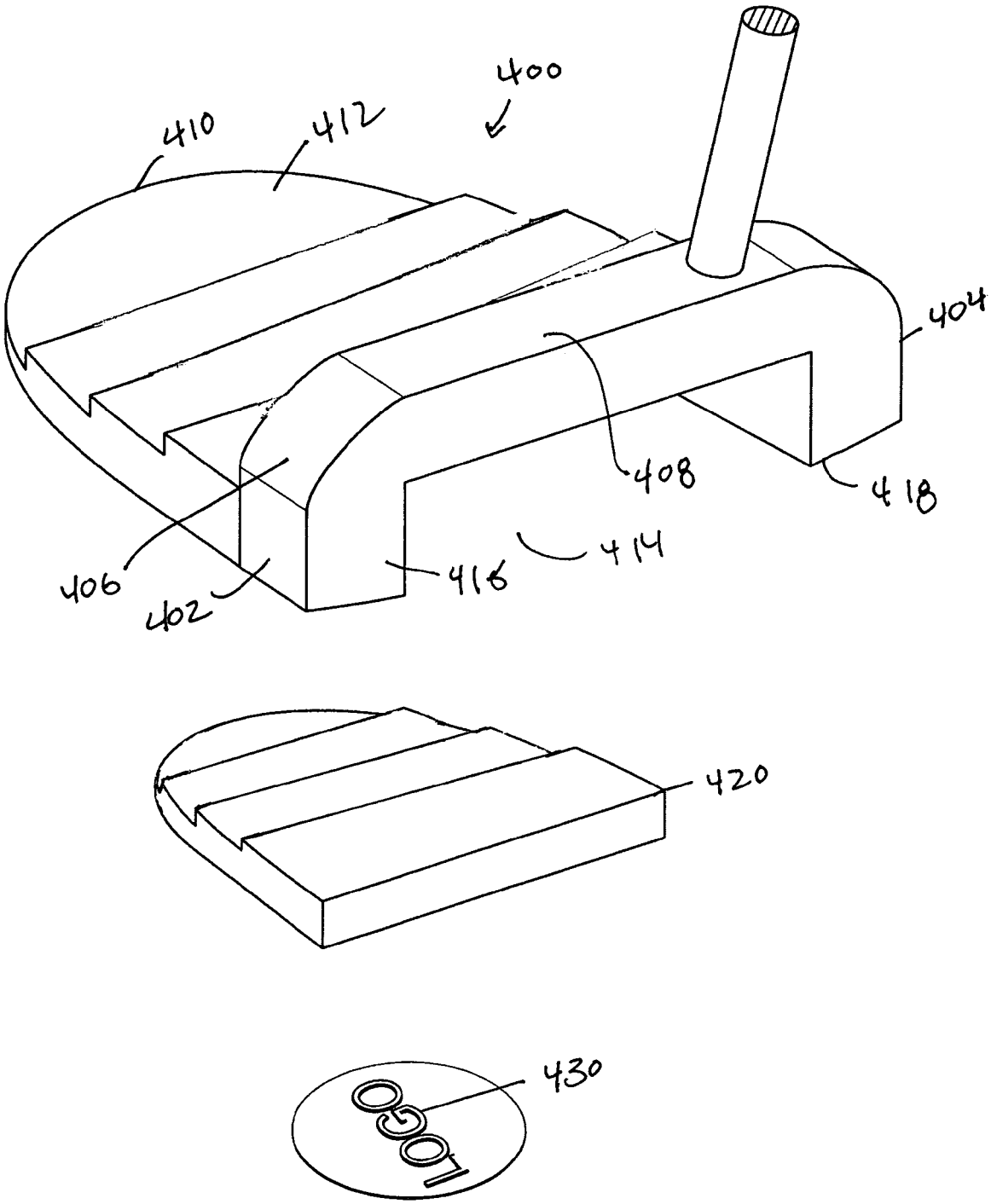
FIG. 10 is a rear exploded view of a fourth alternative club head in accordance with the present invention.
Figure 11:
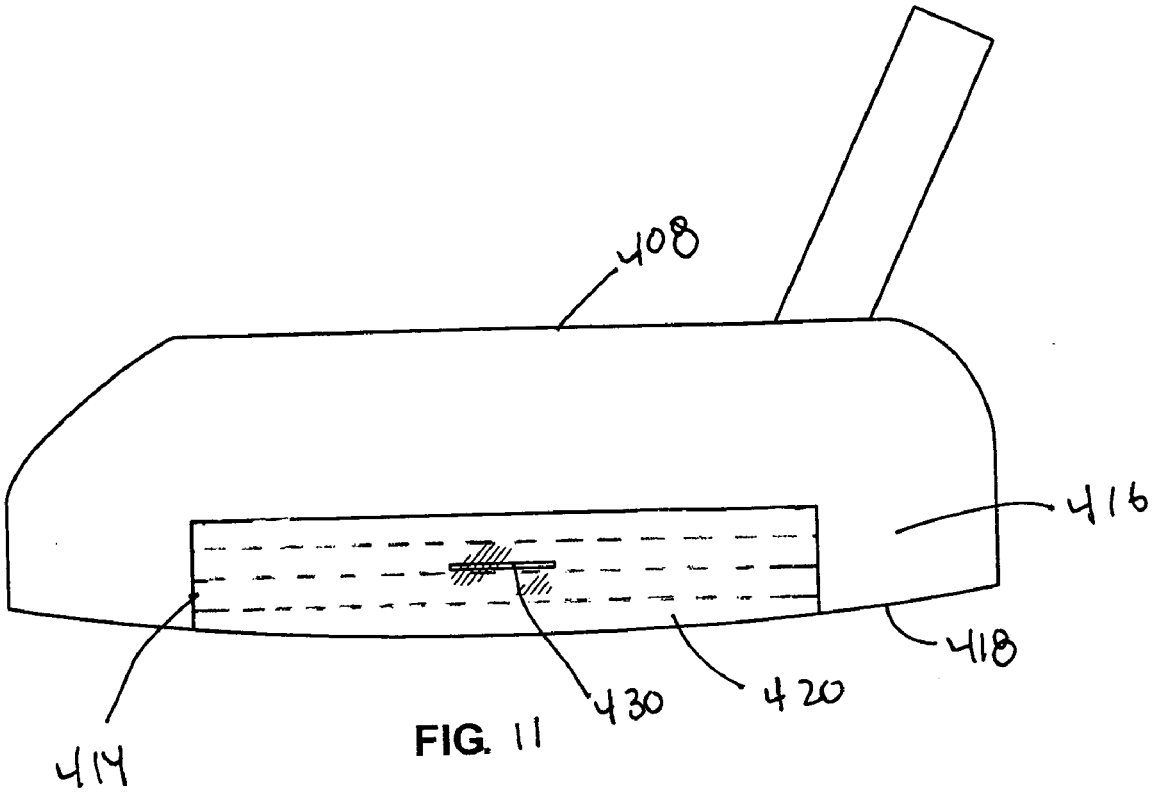
FIG. 11 is a front view of FIG. 10.
Figure 12:
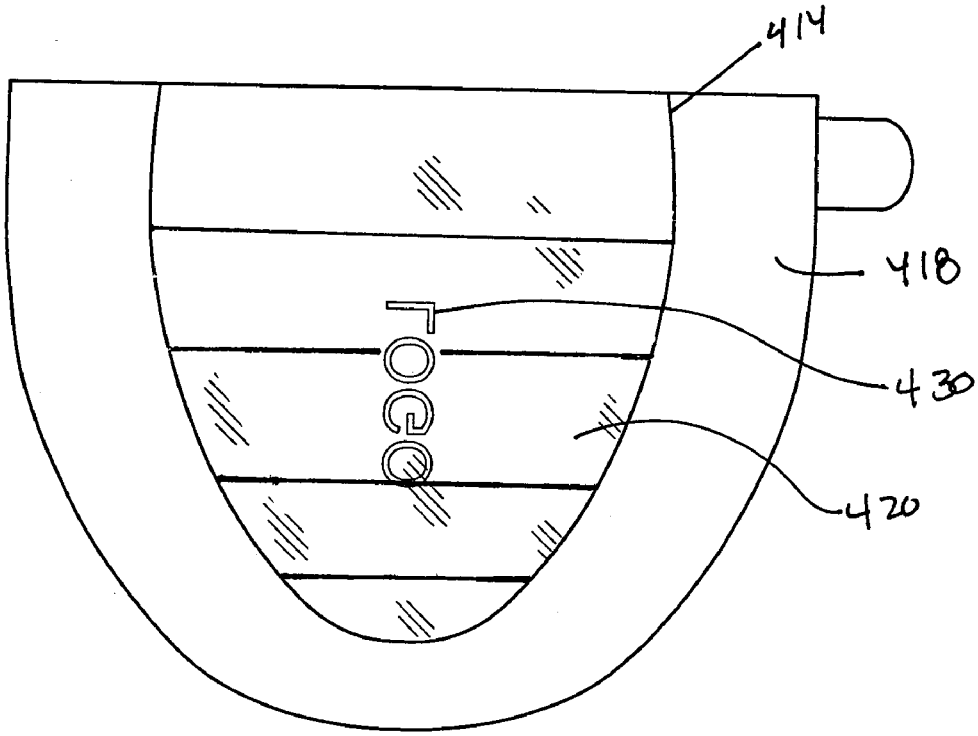
FIG. 12 is a bottom view of FIG. 10.

Referring now to FIG. 10 through 12, the golf club head 400 includes a body 402 shaped similarly to the previous first embodiment. The body 402 has a heel 404, a toe 406, a front portion 408, and a back portion 410. The top portion 412 of the body 402 is solid with a bore 414 defined in the face 416 and lower portion 418 of the body 402. The bore 414 is fitted with an insert 420 that is transparent or semi transparent. Within the insert 420 is indicia 430. This permits the indicia 430 to be viewed only from bottom of the club head or when the club head is turned over and resting in a golf bag. Therefore the user is not distracted from the indicia when the club is in use.

Figure 13:
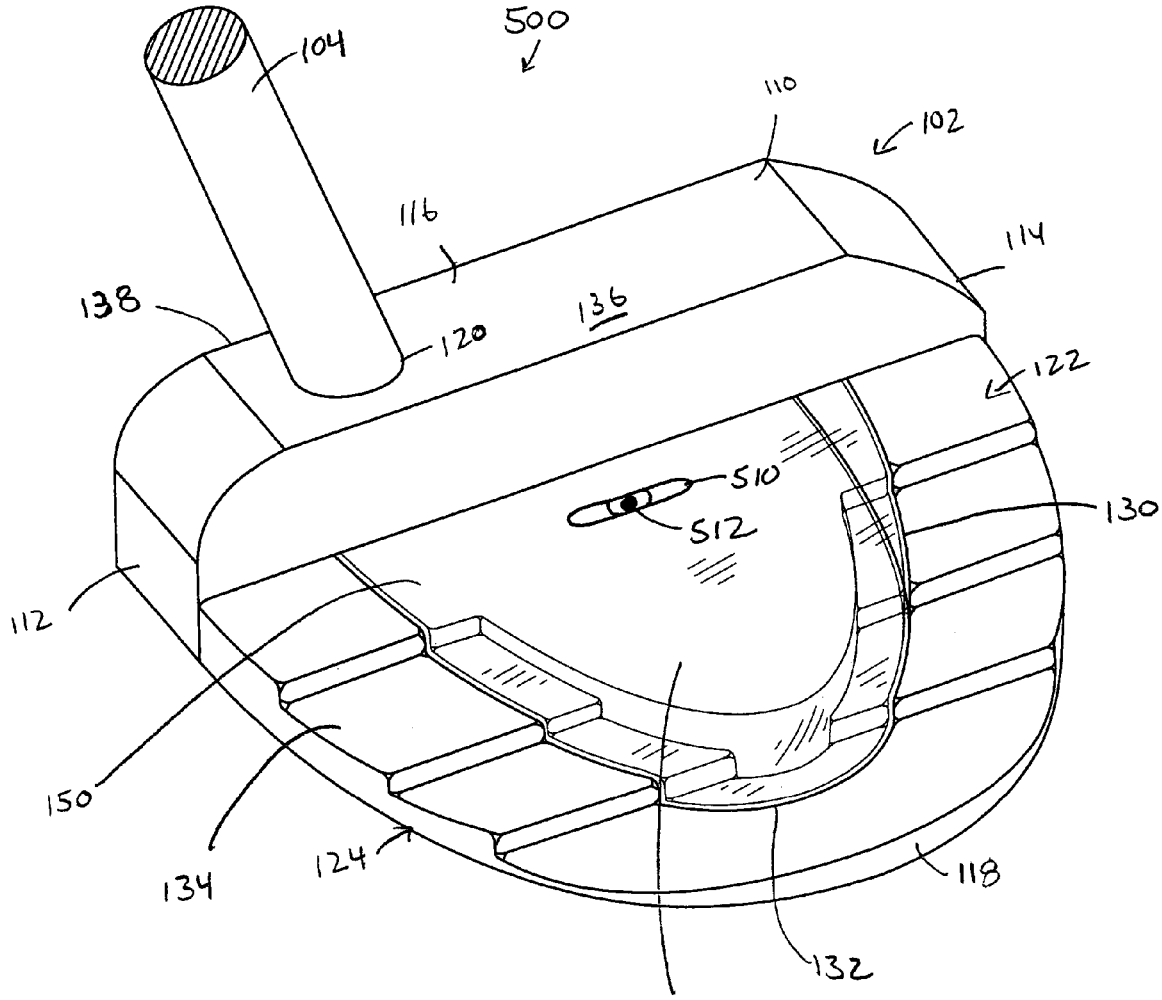
FIG. 13 is a perspective view of a fifth alternative club head in accordance with the present invention.
Figure 14:
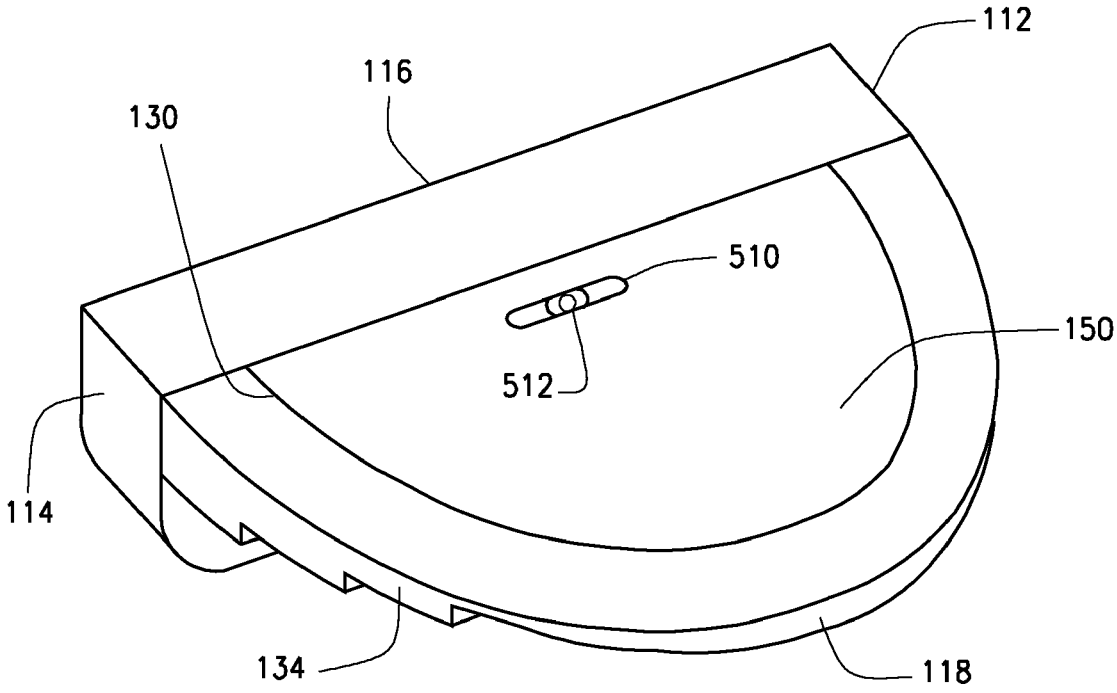
FIG. 14 is a bottom view of a fifth alternative club head in accordance with the present invention.

Referring now to FIG. 13, a fifth golf club head 500 is illustrated. The fifth golf club head 500 is similar to the first embodiment 100, and similar parts have similar reference numbers. Unlike the previous embodiment with indicia, the insert 150 includes a leveling indicator 510 positioned substantially parallel to the bottom surface. The leveling indicator 510 provides the user with a spirit level or "bubble" 512 for orientation leveling device to indicate when the leveling indicator 510 is substantially horizontal. It is to be understood that the spirit level constitutes a glass vial within which is located a liquid and contained within that liquid is an air bubble. The construction of such spirit level is deemed to be conventional. The leveling indicator 510 acts as a training device to allow the user to gain a better understanding of the levelness of the club head relative to the surface being putting on. When the club head is level, the putter will strike the ball flush and allow for a more accurate roll as opposed to striking the ball at an include or decline an thus negatively impacting the roll of the ball. A flush impact would also maximize the effect of the insert material used in the putter face to better control the roll of the ball.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A golf club head having upper and lower surfaces, comprising: a body defined as having a heel, toe, front portion with a defined striking face, a back portion; the front portion and the back portion made from a same material; an aperture through the body extending from the upper surface to the lower surface and extending from the front portion to an inside portion; an insert secured within the aperture; the body is completely around the insert; and an indicia embedded in the insert that is visible from the upper and lower surfaces of the golf club head.

2. The club head of claim 1, wherein the inside portion is further defined as a portion between the front portion and the back portion.

3. The club head of claim 1, wherein the aperture further extends from the striking face to the inside portion and the insert has a face corresponding to at least a portion of the striking face.

4. The club head of claim 1, wherein the insert is of a transparent or semi transparent material.

5. The club head of claim 1, wherein the body is of a material selected from one or more of the following, bismuth metal, bismuth oxide, or bismuth trioxide.

6. A golf club head having upper and lower surfaces, comprising: a body defined as having a heel, toe, front portion with a defined striking face, a back portion; an aperture in the body extending from the upper surface to the lower surface and extending from the front portion to an inside portion; an insert secured within the aperture; and a level positioned substantially parallel to the lower surface within the insert that is visible from the upper and lower surfaces of the golf club head.

7. The club head of claim 6, wherein the inside portion is further defined as a portion between the front portion and the back portion.

8. The club head of claim 6, wherein the aperture further extends from the striking face to the inside portion and the insert has a face corresponding to at least a portion of the striking face.

9. The club head of claim 6, wherein the insert is of a transparent or semi transparent material.

10. A golf club head having upper and lower surfaces, comprising: a body defined as having a heel, toe, front portion with a defined striking face, a back portion; an aperture through the body extending from the upper surface to the lower surface and extending from the front portion to an inside portion; an insert secured within the aperture of the body; wherein the body is completely around the insert, and an indicia within the insert that is visible from the upper and lower surfaces of the golf club head.

11. The club head of claim 10, wherein the insert is of a transparent or semi transparent material.

12. A golf club head having upper and lower surfaces, comprising: a body defined as having a heel, toe, front portion with a defined striking face, a back portion; the back portion including a backside arc portion extending from the heel to the toe to form an aperture in the body; the aperture extending from the upper surface to the lower surface; an insert secured within the aperture of the body; an indicia within the insert that is visible from the upper and lower surfaces of the golf club head.

13. The club head of claim 12, wherein the insert is of a transparent or semi transparent material.

14. A golf club head having upper and lower surfaces, comprising: a body defined as having a heel, toe, front portion with a defined striking face, and a back portion; an aperture in the body; the aperture extending from the upper surface to the lower surface; an insert secured within the aperture of the body; an indicia within the insert that is visible from the upper and lower surfaces of the golf club head, wherein the front portion and the back portion are made from the same material as the heel and the toe.

* * * * *